US008286371B2

(12) United States Patent
Baker et al.

(10) Patent No.: US 8,286,371 B2
(45) Date of Patent: Oct. 16, 2012

(54) ARTICLE OF FOOTWEAR WITH CLEAT MEMBERS

(75) Inventors: Brian D. Baker, Portland, OR (US); Thomas W. Jackson, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 431 days.

(21) Appl. No.: 12/547,918

(22) Filed: Aug. 26, 2009

(65) Prior Publication Data

US 2011/0047834 A1 Mar. 3, 2011

(51) Int. Cl.
*A43C 15/16* (2006.01)
*A43C 15/02* (2006.01)

(52) U.S. Cl. ..... 36/67 A; 36/59 C; 36/128

(58) Field of Classification Search ..... 36/59 C, 36/67 A, 127, 128, 129, 134
See application file for complete search history.

(56) References Cited

U.S. PATENT DOCUMENTS

| | | | | |
|---|---|---|---|---|
| 4,184,272 | A | 1/1980 | Riggs | |
| 4,327,503 | A | 5/1982 | Johnson | |
| 4,559,724 | A * | 12/1985 | Norton | 36/129 |
| 4,885,851 | A | 12/1989 | Peterson | |
| D327,975 | S | 7/1992 | Saito et al. | |
| 5,483,760 | A | 1/1996 | Kataoka et al. | |
| 5,533,282 | A | 7/1996 | Kataoka et al. | |
| 5,581,913 | A | 12/1996 | Kataoka et al. | |
| 5,689,904 | A | 11/1997 | Kataoka et al. | |
| 5,724,754 | A | 3/1998 | Kataoka et al. | |
| 5,752,332 | A | 5/1998 | Kataoka et al. | |
| 5,775,010 | A | 7/1998 | Kaneko | |
| 5,956,871 | A | 9/1999 | Korsen | |
| 6,138,386 | A | 10/2000 | Singer et al. | |
| 6,161,315 | A * | 12/2000 | Dalton | 36/134 |
| D440,750 | S | 4/2001 | Waterbury | |
| 6,253,468 | B1 | 7/2001 | Hirota | |
| 6,289,611 | B1 * | 9/2001 | Patterson et al. | 36/127 |
| 6,338,208 | B1 | 1/2002 | Waterbury | |
| 6,354,022 | B2 * | 3/2002 | Gelsomini | 36/127 |
| 6,381,878 | B1 | 5/2002 | Kennedy, III et al. | |
| 6,631,571 | B2 | 10/2003 | McMullin | |
| 6,675,505 | B2 | 1/2004 | Terashima | |
| 6,793,996 | B1 | 9/2004 | Umezawa | |
| 6,834,446 | B2 | 12/2004 | McMullin | |
| 6,904,707 | B2 | 6/2005 | McMullin | |
| 6,948,264 | B1 | 9/2005 | Lyden | |

(Continued)

FOREIGN PATENT DOCUMENTS

| | | |
|---|---|---|
| DE | 3032268 | 4/1982 |

(Continued)

OTHER PUBLICATIONS

The International Search Report and Written Opinion mailed Jan. 24, 2011 in International Application No. PCT/US2010/046609.

(Continued)

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear including three cleat member sets is disclosed. A first cleat member set is tuned to provide maximum traction on soft natural grass. A second cleat member set is tuned to provide maximum traction on firm natural grass. A third cleat member set is tuned to provide maximum traction on artificial turf. The sizes, material properties and arrangement of each cleat member set is varied.

13 Claims, 4 Drawing Sheets

U.S. PATENT DOCUMENTS

| | | | |
|---|---|---|---|
| 7,073,280 | B2 | 7/2006 | Terashima |
| 7,134,226 | B2 | 11/2006 | Robinson, Jr. et al. |
| 7,398,610 | B2 | 7/2008 | McMullin |
| 2005/0108902 | A1 | 5/2005 | McMullin |
| 2005/0278981 | A1 | 12/2005 | McMullin |
| 2006/0090373 | A1 | 5/2006 | Savoie et al. |
| 2007/0062070 | A1 | 3/2007 | Kuhtz et al. |
| 2008/0072459 | A1 | 3/2008 | Robinson et al. |
| 2008/0072460 | A1 | 3/2008 | Robinson et al. |
| 2008/0196276 | A1 | 8/2008 | McMullin |
| 2008/0201992 | A1 | 8/2008 | Avar et al. |
| 2008/0271346 | A1 | 11/2008 | Farmer |
| 2008/0301973 | A1 | 12/2008 | Lee |
| 2009/0013561 | A1 | 1/2009 | Robinson, Jr. et al. |
| 2009/0056169 | A1 | 3/2009 | Robinson, Jr. et al. |

FOREIGN PATENT DOCUMENTS

| | | |
|---|---|---|
| DE | 4316650 | 11/1993 |
| GB | 2223394 | 4/1990 |

OTHER PUBLICATIONS

International Preliminary Report on Patentability (including Written Opinion of the ISA) mailed Mar. 8, 2012 in International Application No. PCT/US2010/046609.

* cited by examiner

ARTICLE OF FOOTWEAR WITH CLEAT MEMBERS

BACKGROUND

The present invention relates generally to an article of footwear, and in particular to an article of footwear with cleat members.

Articles of footwear with cleat members of different sizes have been previously proposed. Sumitomo (U.S. Pat. No. 6,793,996) teaches a cleat structure that includes a variety of projections on a shoe sole. Sumitomo teaches a pin that is the tallest cleat. Sumitomo teaches that the hardness of the pin is greater than an adjacent cleat element. Additionally, British patent application publication number 2,223,394 teaches a shoe sole including a variety of cleats formed integrally with the sole that penetrate only a small distance into the ground with removable, larger cleats that can penetrate more deeply. The integral cleats can be cylindrical in shape and have a rounded top surface.

The related art lacks provisions for providing footwear that can achieve maximum traction on various types of ground surfaces. There is a need for articles that address the limitations of the related art.

SUMMARY

In one aspect, the invention provides an article of footwear including a sole structure, the sole structure including a first cleat member set, a second cleat member set and a third cleat member set associated with a first diameter, a second diameter and a third diameter, respectively; the first diameter being substantially smaller than the second diameter and the second diameter being substantially smaller than the third diameter; the first cleat member set having a greater number of cleat members than the second cleat member set and the second cleat member set having a greater number of cleat members than the third cleat member set; the first cleat member set, the second cleat member set and the third cleat member set being associated with a first rigidity, a second rigidity and a third rigidity, respectively; and wherein the first rigidity is substantially greater than the second rigidity and wherein the second rigidity is substantially greater than the third rigidity.

In another aspect, the invention provides an article of footwear, comprising: a sole structure, the sole structure including a first cleat member set, a second cleat member set and a third cleat member set associated with a first height, a second height and a third height, respectively; the first height being substantially smaller than the second height and the second height being substantially smaller than the third height; the first cleat member set having a greater number of cleat members than the second cleat member set and the second cleat member set having a greater number of cleat members than the third cleat member set; and wherein the third cleat member set is configured to deform by a greater amount than the second cleat member set and wherein the second cleat member set is configured to deform by a greater amount than the first cleat member set.

In another aspect, the invention provides An article of footwear, comprising: a sole structure, the sole structure including a first cleat member set, a second cleat member set and a third cleat member set; the first cleat member set comprising cleat members having a first size, the second cleat member set comprising cleat members having a second size that is greater than the first size and the third cleat member set comprising cleat members having a third size that is greater than the second size; the first cleat member set having a greater number of cleat members than the second cleat member set and the second cleat member set having a greater number of cleat members than the third cleat member set; the first cleat member set, the second cleat member set and the third cleat member set being associated with a first rigidity, a second rigidity and a third rigidity, respectively; the first rigidity being substantially greater than the second rigidity and the second rigidity being substantially greater than the third rigidity; and wherein each of the cleat members of the first cleat member set, the second cleat member set and the third cleat member set are arranged in an approximately discontinuous grid on the sole structure.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
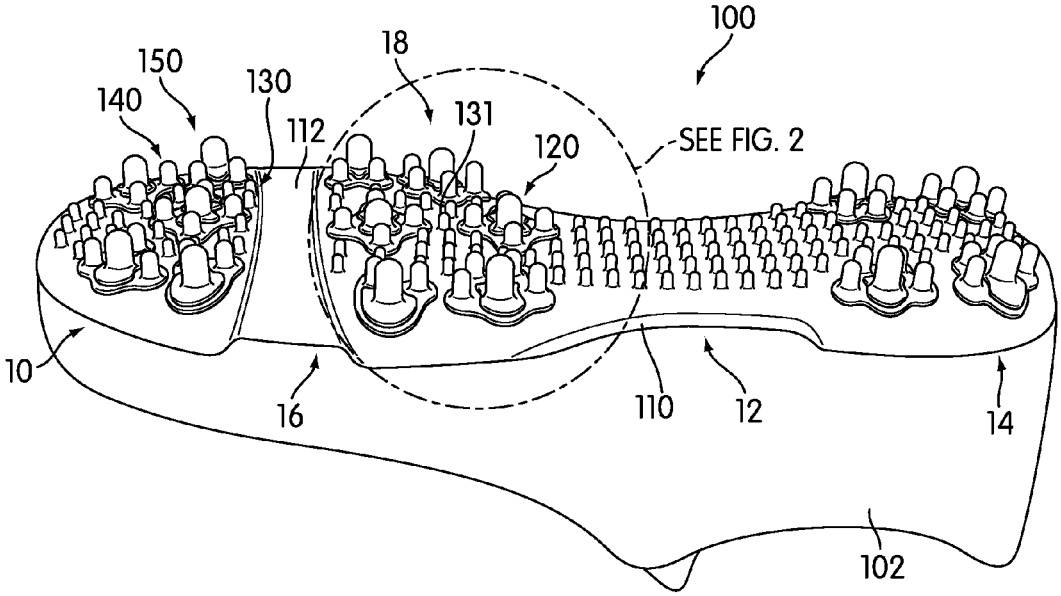
FIG. 1 is an isometric view of an embodiment of an article of footwear comprising three distinct cleat member sets.
Figure 2:
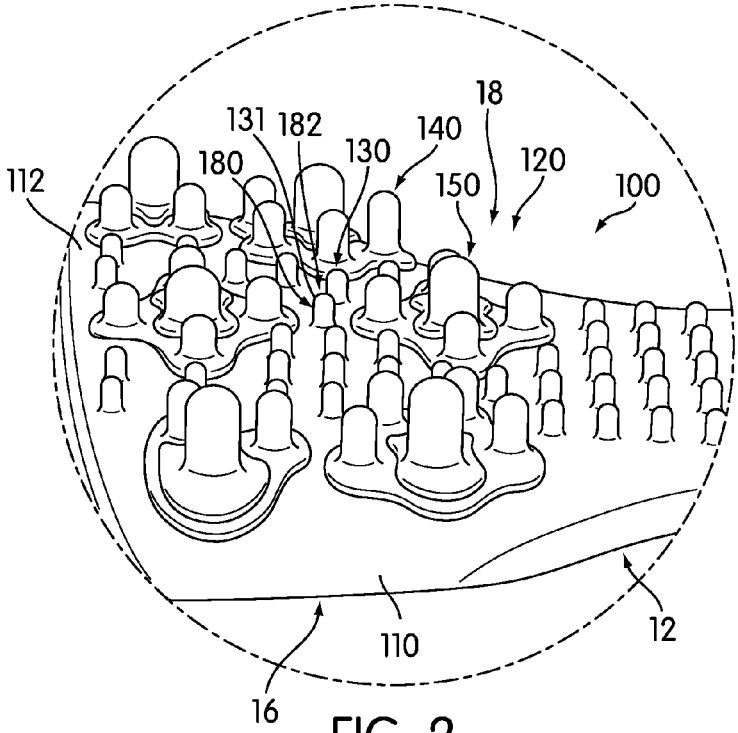
FIG. 2 is an enlarged isometric view of an embodiment of an article of footwear comprising three distinct cleat member sets.

FIGS. 1 and 2 illustrate isometric views of an exemplary embodiment of article of footwear 100. For clarity, the following detailed description discusses an exemplary embodiment, in the form of a soccer shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 and 2, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include upper 102. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Article 100 can include sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. Sole structure 110 extends between upper 102 and the ground when article 100 is worn. In different embodiments, sole structure 110 may include different components. For example, sole structure 110 may include an outsole, a midsole, and/or an insole. In some cases, one or more of these components may be optional.

In some embodiments, sole structure 110 may include lower plate 112. In some cases, lower plate 112 may be a partially rigid plate that extends across a substantial majority of a lower surface of sole structure 110. In one embodiment, lower plate 112 may cover a substantial entirety of the lower surface of sole structure 110. This arrangement may provide a partially rigid lower surface for sole structure 110.

In some cases, sole structure 110 can be configured according to one or more types of ground surfaces on which sole structure 110 may be used. Examples of ground surfaces include, but are not limited to: natural turf, synthetic turf, dirt, natural grass, soft natural grass, as well as other surfaces. In some embodiments, lower plate 112 may be provided with one or more cleat members. The term "cleat members" as used in this detailed description and throughout the claims includes any provisions disposed on a sole for increasing traction through friction or penetration of a ground surface. Typically, cleat members may be configured for football, soccer, baseball or any type of activity that requires traction.

Sole structure 110 may include plurality of cleat members 120 that extend from lower plate 112. Generally, plurality of cleat members 120 may be associated with sole structure 110 in any manner. In some embodiments, plurality of cleat members 120 may be screwed into holes within lower plate 112. In other embodiments, plurality of cleat members 120 may be attached to lower plate 112 using any other provisions. In still other embodiments, plurality of cleat members 120 may be integrally formed with sole structure 110. Still further, in some cases, some cleat members of plurality of cleat members 120 may be integrally formed with lower plate 112, while other cleat members may be attached to lower plate 112.

An article of footwear including cleat members can include provisions for maximizing traction between a sole structure and multiple types of ground surfaces. In some embodiments, an article can include cleat members disposed in different locations to achieve maximum traction on multiple types of surfaces. In other embodiments, an article can include distinct types of cleats that each maximize traction for a distinct type of surface.

In some embodiments, plurality of cleat members 120 may comprise distinct types of cleats that have various characteristics that provide for different types of traction with a surface. Examples of different cleat characteristics include, but are not limited to: cleat geometry, cleat height, cleat diameter, material rigidity as well as other characteristics. In some cases, plurality of cleat members 120 may comprise at least two distinct types of cleats having different characteristics. In other cases, plurality of cleat members 120 may comprise at least three distinct types of cleats having different characteristics. In still other cases, plurality of cleat members 120 could comprise four or more distinct types of cleats having different characteristics. In this exemplary embodiment, plurality of cleat members 120 may comprise three different types of cleat members, indicated respectively as first cleat member set 130, second cleat member set 140 and third cleat member set 150.

Each of first cleat member set 130, second cleat member set 140 and third cleat member set 150 can be distinguished according to various cleat properties such as size and material properties. For example, in some cases, each cleat member set can comprise cleat members of distinct sizes. In other cases, each cleat member set can comprise cleat members of distinct material properties. In still other cases, each cleat member set can comprise cleat members of distinct geometries.

In some embodiments, each cleat member of plurality of cleat members 120 may be provided with an approximately cylindrical body portion and an approximately rounded tip portion. For example, in the current embodiment, first cleat member 131 of first cleat member set 130 comprises a substantially cylindrical body portion 180 and a substantially rounded tip portion 182. Similarly, each cleat member of first cleat member set 130, second cleat member set 140 and third cleat member set 150 may comprise substantially similar geometries to first cleat member 131. In other embodiments, however, it will be understood that different cleat member sets could comprise cleat members having substantially different geometries. As an example, in another embodiment, one or more cleat member sets could comprise cleat members having conical geometries or truncated conical geometries.

Figure 3:
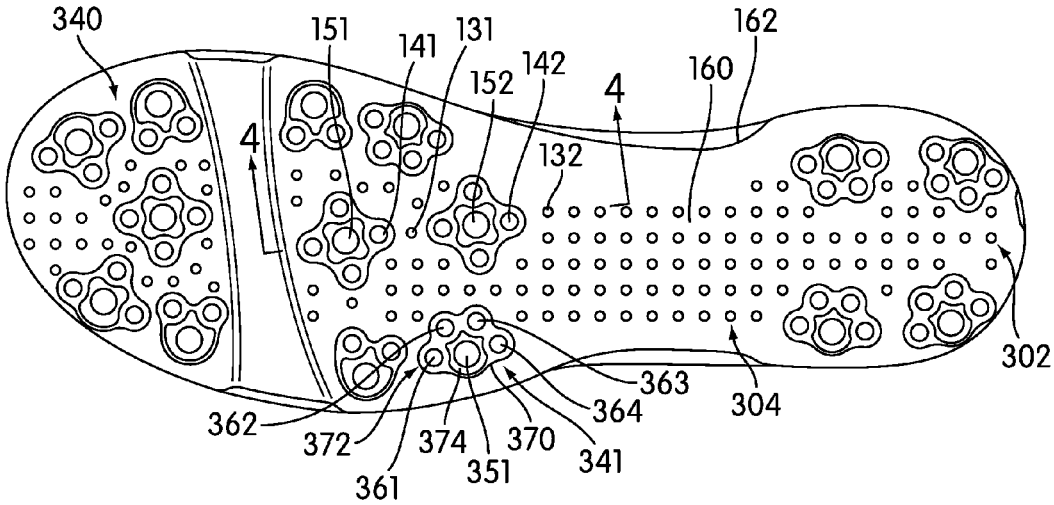
FIG. 3 is a plan view of an embodiment of an article of footwear comprising three distinct cleat member sets.
Figure 4:
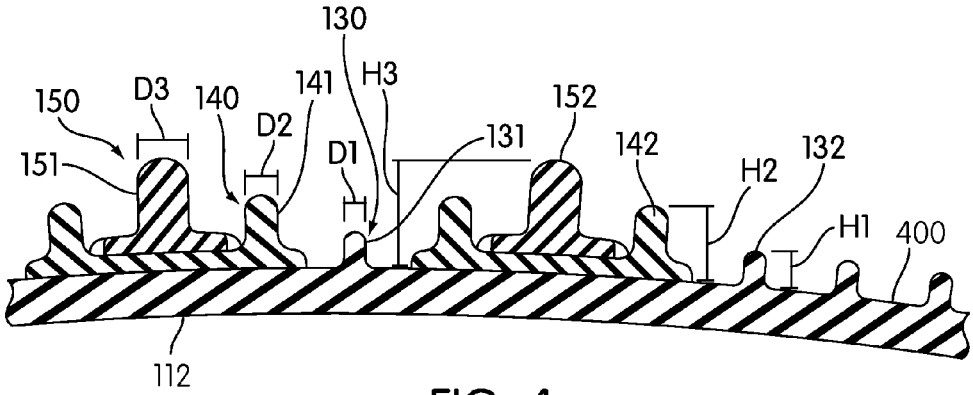
FIG. 4 is a cross sectional view of an embodiment of an article of footwear.

Referring now to FIGS. 3 and 4, in different embodiments, the approximate diameters of cleat members in each respective cleat member set could vary. In the current embodiment, first cleat member set 130, represented in FIG. 4 by first cleat member 131, may be associated with first diameter D1. In other words, each cleat member of first cleat member set 130 may have a diameter that is substantially similar to first diameter D1 of first cleat member 131. In a similar manner, second cleat member set 140, represented in FIG. 4 by second cleat member 141, may be associated with second diameter D2. In other words, each cleat member of second cleat member set 140 may have a diameter that is substantially similar to second diameter D2 of second cleat member 141. Likewise, third cleat member set 150, represented in FIG. 4 by third cleat member 151, may be associated with third diameter D3. In other words, each cleat member of third cleat member set 150 may have a diameter that is substantially similar to third diameter D3 of third cleat member 151. In this embodiment, first diameter D1 is substantially smaller than second diameter D2 and third diameter D3. Also, second diameter D2 is substantially smaller than third diameter D3. In other words, first diameter D1, second diameter D2 and third diameter D3 have increasing values in that same order.

In different embodiments, the values of first diameter D1, second diameter D2 and third diameter D3 could vary. In some embodiments, first diameter D1 could have a value approximately in the range between 1 mm and 4 mm. Also, second diameter D2 could have a value approximately in the range between 2 mm and 6 mm. In addition, third diameter D3 could have a value approximately in the range between 5 mm and 12 mm. In an exemplary embodiment, first diameter D1, second diameter D2 and third diameter D3 may have approximate values of 2 mm, 4 mm and 8 mm, respectively. In other embodiments, however, diameter D1, diameter D2 and diameter D3 could have any other values.

By using cleat member sets with cleat members of increasing diameter, the contact area between each cleat member set and a ground surface may vary so that each cleat may be tuned to provide maximum traction for a different type of surface. In the current embodiment, first cleat member set 130 may have a relatively small diameter that is optimized for maximizing traction with soft natural grass. In addition, third cleat member set 150 may have a relatively large diameter that is optimized for maximizing traction with a synthetic surface. Furthermore, second cleat member 140 may have an intermediate sized diameter that is optimized for maximizing traction with firm natural grass.

In different embodiments, the approximate heights of cleat members in each respective cleat member set could vary. In term height, as used in this detailed description and in the claims, refers to the height of a cleat member as measured from lower surface 400 of lower plate 112. In the current embodiment, first cleat member set 130, represented in FIG. 4 by fourth cleat member 132, may be associated with first height Hl. In other words, each cleat member of first cleat member set 130 may have a height that is substantially similar to first height H1 of fourth cleat member 132. In a similar manner, second cleat member set 140, represented in FIG. 4 by fifth cleat member 142, may be associated with second height H2. In other words, each cleat member of second cleat member set 140 may have a height that is substantially similar to second height H2 of fifth cleat member 142. Likewise, third cleat member set 150, represented in FIG. 4 by sixth cleat member 152, may be associated with third height H3. In other words, each cleat member of third cleat member set 150 may have a height that is substantially similar to third height H3 of sixth cleat member 152. In this embodiment, first height H1 is substantially smaller than second height H2 and third height H3. Also, second height H2 is substantially smaller than third height H3. In other words, first height H1, second height H2 and third height H3 have increasing values in that same order.

In different embodiments, the values of first height H1, second height H2 and third height H3 could vary. In some embodiments, first height H1 could have a value approximately in the range between 3 mm and 9 mm. Also, second height H2 could have a value approximately in the range between 4 mm and 10 mm. In addition, third height H3 could have a value approximately in the range between 7 mm and 14 mm. In an exemplary embodiment, height H1, height H2 and height H3 could have approximate values of 5 mm, 7 mm and 10 mm, respectively. In other embodiments, however, first height H1, second height H2 and third height H3 could have any other values.

By using cleat member sets with cleat members of increasing height, the depth of penetration of each cleat member set into a ground surface may vary so that each cleat can be tuned to provide maximum traction for a different type of surface. In the current embodiment, first cleat member set 130 may have a relatively small height that is optimized for maximizing traction with soft natural grass. In addition, third cleat member set 150 may have a relatively large height that is optimized for maximizing traction with a synthetic surface. Furthermore, second cleat member 140 may have an intermediate sized height that is optimized for maximizing traction with natural grass.

In different embodiments, the material properties of cleat members in each respective cleat member set could vary. In some embodiments, each cleat member set may be associated with different rigidities. In an exemplary embodiment, first cleat member set 130, second cleat member set 140 and third cleat member set 150 may be associated with first rigidity, second rigidity and third rigidity, respectively. In some embodiments, the first rigidity may be substantially greater than the second rigidity and the third rigidity. Additionally, the second rigidity may be substantially greater than the third rigidity. In other words, the first rigidity, the second rigidity and the third rigidity may have decreasing values in that order.

The differing rigidities of first cleat member set 130, second cleat member set 140 and third cleat member set 150 can be achieved in various ways. As an example, in the exemplary embodiment first cleat member set 130, second cleat member set 140 and third cleat member set 150 may comprise a first material, a second material and a third material, respectively. In this case, the first material, the second material and the third material may be substantially different materials having substantially different rigidities. In particular, the first material may be made of a substantially rigid material such as plastic. In addition, the second material may be a semi-rigid material such as hard foam. Furthermore, the third material may be a substantially deformable material such as a semi-rigid foam. However, it will be understood that any other materials with increasing levels of hardness could be used. In still other embodiments, it may be possible to modify the rigidity of one or more cleat members by varying the geometry and/or structure of the cleat members.

By varying the rigidity of each cleat member set, each cleat member set may deform by a substantially different amount upon contact with a ground surface. This arrangement allows each cleat to be tuned for maximizing traction with a different type of ground surface. In the current embodiment, first cleat member set 130 may have a relatively high rigidity that is optimized for maximizing traction with soft natural grass. In addition, third cleat member set 150 may have a relatively low rigidity that is optimized for maximizing traction with a synthetic surface. Furthermore, second cleat member set 140 may have an intermediate rigidity that is optimized for maximizing traction with firm natural grass.

In some embodiments, first cleat member set 130, second cleat member set 140 and third cleat member set 150 may be further distinguished by the number of cleat members in each set. In one embodiment, the number of cleat members in first cleat member set 130 may be substantially greater than the number of cleats in second cleat member set 140 and third cleat member set 150. Furthermore, the number of cleat members in second cleat member set 140 may be substantially greater than the number of cleats in third cleat member set 150. In other words, the number of cleat members in first cleat member set 130, second cleat member set 140 and third cleat member set 150 may decrease in that same order. By varying the number of cleats associated with each cleat member set, each cleat member set can be optimized for providing traction with various types of surfaces.

In some embodiments, first cleat member set 130 may comprise approximately 50 to 150 cleat members. In an exemplary embodiment, first cleat member set 130 may comprise approximately 110 to 130 cleat members. In some embodiments, second cleat member set 140 may comprise approximately 25 to 75 cleat members. In an exemplary embodiment, second cleat member set 140 may comprise approximately 45 to 55 cleat members. In some embodiments, third cleat member set 150 may comprise approximately 5 to 25 cleat members. In an exemplary embodiment, third cleat member set may comprise approximately 12 to 17 cleat members.

In different embodiments, the arrangement of cleat members on a sole structure may vary. In some embodiments, cleat members may be arranged in a random manner on a sole structure. In other embodiments, cleat members may be arranged in a regular pattern on a sole structure. In an exemplary embodiment, plurality of cleat members 120 may be approximately arranged in a discontinuous grid over lower plate 112. For example, in this embodiment, cleat members of first cleat member set 130 are approximately aligned in columns 302 and rows 304 throughout forefoot portion 10, midfoot portion 12 and heel portion 14. In this case, columns 302 are approximately parallel with a longitudinal direction of sole structure 110, while rows 304 are approximately parallel with a lateral direction of sole structure 110. Additionally, cleat members in second cleat member set 140 and third cleat member set 150 may be approximately aligned with columns 302 and rows 304 formed by first cleat member set 130. This discontinuous grid-like arrangement may provide for generally even ground contact that can help maximize traction on various surfaces.

In some embodiments, each cleat member set may be arranged on a sole structure in a manner that optimizes traction on various types of surfaces. In one embodiment, first cleat member set 130 may comprise a plurality of cleat members that are arranged generally within central portion 160 of lower plate 112. In contrast, a majority of the cleat members within second cleat member set 140 and third cleat member set 150 may generally be disposed in peripheral portion 162 of lower plate 112, which extends outwardly from central portion 160. In the current embodiments, some cleat members of second cleat member set 140 and third cleat member set 150 are also disposed within central portion 160 of forefoot portion 10. This arrangement helps to achieve maximum traction on synthetic surfaces and harder grasses by providing longer cleats on a periphery of sole structure 110. Additionally, on softer grasses, where a greater amount of lower plate 112 may contact the ground directly, the shorter cleats of first cleat member set 130 may provide enhanced traction throughout a substantial entirety of the center of sole structure 110.

In some embodiments, cleat members comprising second cleat member set 140 and third cleat member set 150 may be substantially clustered together on lower plate 112. For example, in the current embodiment, cleat members comprising third cleat member set 150 are generally disposed adjacent to, or surrounded by, cleats comprising second cleat member set 140. In general, each cleat member of third cleat member set 150 is surrounded by between two and four cleat members from second cleat member set 140. In other embodiments, however, the number of cleats from second cleat member set 140 surrounding cleat members of third cleat member set 150 could vary. As an example, the current embodiment illustrates a plurality of clustered arrangements 340. For example, first clustered arrangement 341 comprises first cleat member 351 from third cleat member set 150 surrounded by first cleat member 361, second cleat member 362, third cleat member 363 and fourth cleat member 364 of second cleat member set 140. Furthermore, in this embodiment, first cleat member 361, second cleat member 362, third cleat member 363 and fourth cleat member 364 are joined together by base portion 370 that is attached to lower plate 112. In particular, first cleat member 361, second cleat member 362, third cleat member 363 and fourth cleat member 364 are disposed on peripheral portion 372 of base portion 370, while first cleat member 351 of third cleat member set 150 is disposed in central portion 374 of base portion 370. In a similar manner, each of the cleat members of second cleat member set 140 are grouped together in clusters generally disposed around a single cleat member of third cleat member set 150. This clustering arrangement may help provide maximum traction at localized regions along a periphery of sole structure 110.

The clustering arrangement illustrated in the current embodiment is only intended as an example of one possible cleat member arrangement. In other embodiments, cleat members of third cleat member set 150 may not be grouped with cleat members of second cleat member set 140. For example, in another embodiment, cleat members of second cleat member set 140 and third cleat member set 150 could be distributed evenly around lower plate 112.

Figure 5:
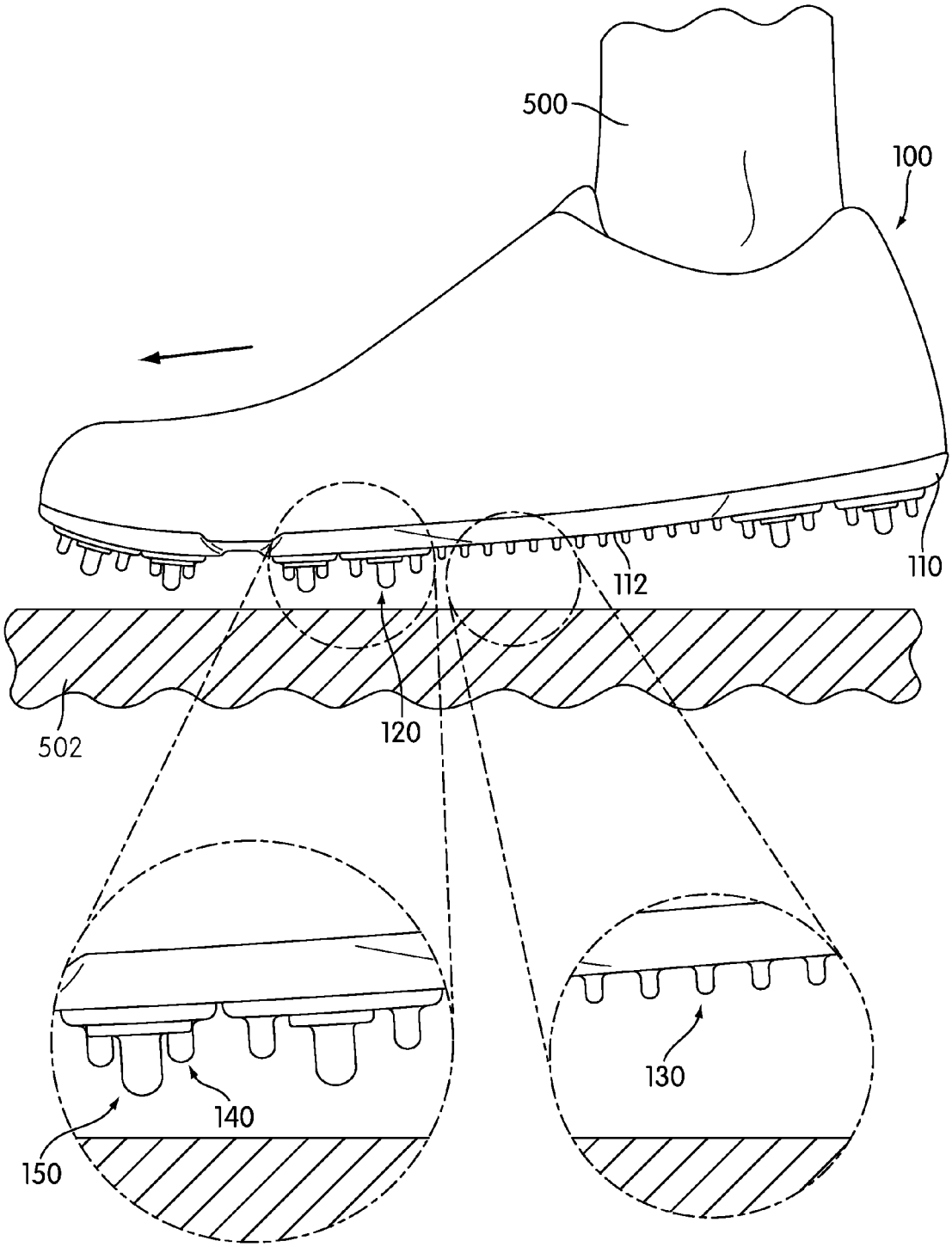
FIG. 5 is a side view of an embodiment of an article of footwear comprising a plurality of cleat members in a pre-deformed state.
Figure 6:
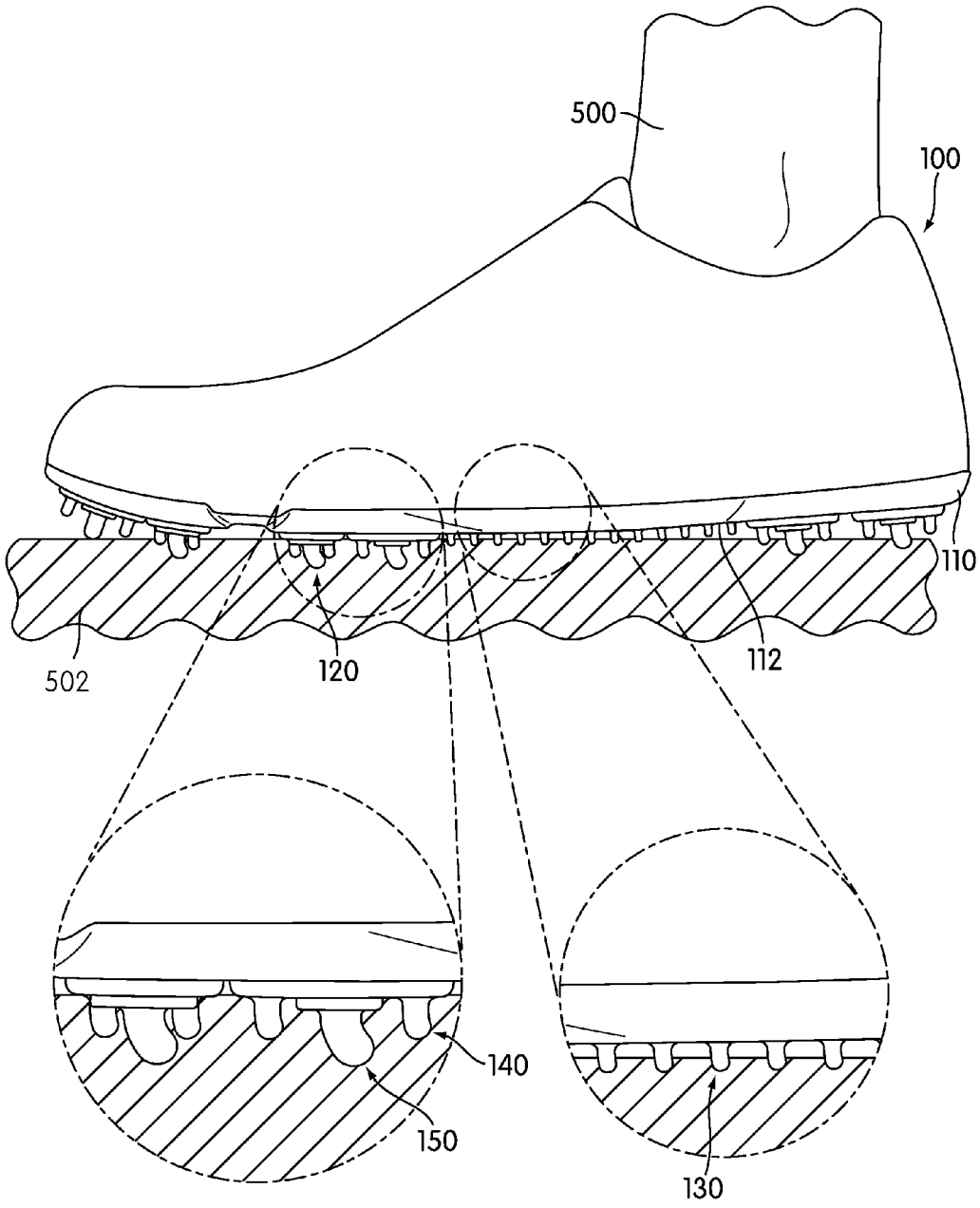
FIG. 6 is a side view of an embodiment of an article of footwear comprising a plurality of cleat members in a deformed state.

FIGS. 5 and 6 are intended to illustrate the deformation properties of various cleat member sets of the current embodiment. In particular, FIG. 5 illustrates plurality of cleat members 120 of sole structure 110 in a pre-deformed state as foot 500 is disposed above ground surface 502. In this situation, plurality of cleat members 120 are generally oriented in a perpendicular manner with respect to lower plate 112. However, as sole structure 110 makes contact with ground surface 502 (as seen in FIG. 6), plurality of cleat members 120 may undergo various amounts of deformation according to the respective rigidity properties of each cleat member set. In the current embodiment, cleat members of first cleat member set 130 undergo a substantially small amount of deformation. In contrast, cleat members of third cleat member set 150 undergo a substantially large amount of deformation. Additionally, cleat members of second cleat member set 140 undergo an intermediate amount of deformation. In other words, cleats of second cleat member set 140 undergo a greater amount of deformation than cleat members of first cleat member set 130 and cleats of second cleat member set 140 undergo a lesser amount of deformation than cleat members of third cleat member set 150.

With this configuration, each cleat member set may undergo an amount of deformation upon contact with a ground surface that is optimized for a particular type of ground surface. For example, first cleat member set 130, comprises cleat members that do not deform much in order to maximize on a soft surface such as soft natural grass. In contrast, third cleat member set 150 comprises cleat members that undergo a higher amount of deformation to maximize traction on artificial turf surfaces, which are difficult to penetrate using cleat members and where it may be undesirable to use rigid cleats that puncture the turf. Similarly, second cleat member set 140 comprises cleat members that undergo an intermediate amount of deformation to maximize traction on surfaces such as hard grass, where more deformation for a cleat member is desirable than on a surface such as soft natural grass.

It will be understood that the combination of characteristics taught in the current embodiment may provide cleat member sets that are optimized for use on different ground surfaces. Specifically, first cleat member set 130 may be provided with generally small cleats of a high rigidity that undergo little deformation upon contact with a ground surface. Furthermore, first cleat member set 130 comprises a large number of cleat members that are generally evenly distributed through a central portion of lower plate 112. With this arrangement, first cleat member set 130 may help to maximize traction on soft natural grass. Additionally, second cleat member set 140 may be provided with intermediate sized cleats of an intermediate rigidity that undergo some deformation upon contact with a ground surface. Furthermore, second cleat member set 140 comprises a relatively small number (when compared to the number of cleats in first cleat member set 130) of cleat members that are localized on an outer periphery of lower plate 112 as well as in a central portion of forefoot 10. With this arrangement, second cleat member set 140 may help to maximize traction on some kinds of natural grass, including harder natural grasses. Third cleat member set 150 may be provided with large sized cleats of a lower rigidity that undergo substantial deformation upon contact with a ground surface. Furthermore, third cleat member set 150 comprises a relatively small number of cleat members that are localized on an outer periphery of lower plate 112 as well as in a central portion of forefoot 10. With this arrangement, third cleat member set 150 may help to maximize traction on artificial turf and other synthetic surfaces.

This arrangement helps to provide maximum traction over multiple surfaces without the need for a user to change footwear. In other words, a single pair of footwear can be used with synthetic turf, natural grass and soft natural grass. This may help save a user the costs associated with purchasing multiple different pairs of footwear for use on different types of surfaces.

It will be understood that while the current embodiment uses three cleat member sets that are optimized for artificial turf, firm natural grasses and soft natural grasses, in other embodiments these cleat member sets could be tuned to provide maximum traction on any other types of surfaces. In other embodiments, the rigidity, height, diameter, location and number of cleat members comprising each cleat member set can be tuned to maximize traction on any types of ground surfaces. Moreover, in still other embodiments, additional cleat member sets could be provided to obtain maximum traction on additional types of ground surfaces. For example, in another embodiment, four distinct cleat member sets could be used for maximizing traction on four different types of ground surfaces.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure, the sole structure including a first cleat member set, a second cleat member set and a third cleat member set associated with a first diameter, a second diameter and a third diameter, respectively;

the first diameter being substantially smaller than the second diameter and the second diameter being substantially smaller than the third diameter;

the first cleat member set having a greater number of cleat members than the second cleat member set and the second cleat member set having a greater number of cleat members than the third cleat member set;

the first cleat member set, the second cleat member set and the third cleat member set being associated with a first rigidity, a second rigidity and a third rigidity, respectively;

wherein the first rigidity is substantially greater than the second rigidity and wherein the second rigidity is substantially greater than the third rigidity;

wherein at least one base portion is attached to the sole structure;

the base portion including at least two cleat members associated with the second cleat member set disposed around a peripheral portion of the base portion and at least one cleat member associated with the third cleat member set disposed in a central portion of the base portion.

2. The article of footwear according to claim 1, wherein the first cleat member set is configured to provide maximum traction on a soft natural grass surface.

3. The article of footwear according claim 1, wherein the second cleat member set is configured to provide maximum traction on a firm natural grass surface.

4. The article of footwear according to claim 1, wherein the third cleat member set is configured to provide maximum traction on an artificial surface.

5. The article of footwear according to claim 1, wherein the third cleat member set is configured to deform substantially more than the second cleat member set.

6. The article of footwear according to claim 5, wherein the second cleat member set is configured to deform substantially more than the first cleat member set.

7. An article of footwear, comprising:

a sole structure, the sole structure including a first cleat member set, a second cleat member set and a third cleat member set;

the first cleat member set comprising cleat members having a first size, the second cleat member set comprising cleat members having a second size that is greater than the first size and the third cleat member set comprising cleat members having a third size that is greater than the second size;

the first cleat member set having a greater number of cleat members than the second cleat member set and the second cleat member set having a greater number of cleat members than the third cleat member set;

the first cleat member set, the second cleat member set and the third cleat member set being associated with a first rigidity, a second rigidity and a third rigidity, respectively;

the first rigidity being substantially greater than the second rigidity and the second rigidity being substantially greater than the third rigidity;

wherein each of the cleat members of the first cleat member set, the second cleat member set and the third cleat member set are arranged in an approximately discontinuous grid on the sole structure;

wherein the sole structure includes at least one clustered arrangement;

the clustered arrangement comprising a base portion attached to the sole structure; and wherein the base portion includes a plurality of cleat members associated with the second cleat member set and at least one cleat member associated with the third cleat member set.

8. The article of footwear according to claim 7, wherein the first cleat member set is disposed on a central portion of the sole structure.

9. The article of footwear according to claim 8, wherein a majority of cleat members comprising the second cleat member set and the third cleat member set are disposed on a peripheral portion of the sole structure, the peripheral portion being disposed outwardly from the central portion.

10. The article of footwear according to claim 7, wherein the first cleat member set comprises approximately 110 to 130 cleat members.

11. The article of footwear according to claim 7, wherein the second cleat member set comprises approximately 45 to 55 cleat members.

12. The article of footwear according to claim 7, wherein the third cleat member set comprises approximately 12 to 17 cleat members.

13. The article of footwear according to claim 7, wherein the at least one clustered arrangement further comprises:

the plurality of cleat members associated with the second cleat member set being disposed around a peripheral portion of the base portion; and the at least one cleat member associated with the third cleat member set being disposed in a central portion of the base portion.

* * * * *